US005927470A

United States Patent [19]

Petropoulos et al.

[11] Patent Number: 5,927,470

[45] Date of Patent: Jul. 27, 1999

[54] SHUTTLE DRIVEN SEPARATOR

[75] Inventors: Steve N. Petropoulos, Chesterfield; Jerry Killikevc, Southgate; Donley Townsend, Detroit; Richard W. Martin, Mt. Clemens; John Jackson, Troy, all of Mich.

[73] Assignee: Chrysler Corporation, Auburn Hills, Mich.

[21] Appl. No.: 08/982,973

[22] Filed: Dec. 2, 1997

[51] Int. Cl.[6] ..... B65G 47/26

[52] U.S. Cl. ..... 198/458; 198/468.01

[58] Field of Search ..... 198/458, 468.3, 198/468.01, 474.1, 476.1; 414/750

[56] References Cited

U.S. PATENT DOCUMENTS

| | | | |
|---|---|---|---|
| 2,975,701 | 3/1961 | Munschauer, Jr. et al. | 100/214 |
| 3,077,259 | 2/1963 | Braun | 198/218 |
| 3,199,443 | 8/1965 | Danly | 100/207 |
| 3,408,689 | 11/1968 | Heiner . | |
| 3,580,442 | 5/1971 | Rohdin | 198/458 |
| 3,653,293 | 4/1972 | Wallis | 83/82 |
| 3,757,961 | 9/1973 | Jacobs | 214/1 |
| 3,768,667 | 10/1973 | Paumier et al. | 214/1 |
| 4,032,018 | 6/1977 | Wallis | 214/1 |
| 4,133,423 | 1/1979 | Zanki | 198/339 |
| 4,349,310 | 9/1982 | Schneider et al. | 414/749 |
| 4,509,638 | 4/1985 | Kato et al. | 198/486 |
| 4,588,070 | 5/1986 | Smith | 198/458 |
| 4,895,013 | 1/1990 | Sofy | 72/405 |
| 4,969,349 | 11/1990 | Maher | 72/405 |
| 5,006,028 | 4/1991 | Jackson | 414/222 |
| 5,159,827 | 11/1992 | Shiraishi et al. | 72/405 |
| 5,483,876 | 1/1996 | Davis et al. | 100/207 |
| 5,520,502 | 5/1996 | Liljengren et al. | 414/751 |
| 5,680,787 | 10/1997 | Fisch | 72/405 |

*Primary Examiner*—William E. Terrell
*Assistant Examiner*—Khoi H. Tran
*Attorney, Agent, or Firm*—Lawrence J. Shurupoff

[57] ABSTRACT

A pair of parts formed in a first stamping operation is removed from a first die press and placed on a separator assembly carried by a shuttle. As the parts are carried by the shuttle to a pair of secondary die presses, they are transversely separated by a stationary cam and a pair of cam followers carried by the shuttle. Once separated, the parts are automatically transferred into the secondary die presses.

9 Claims, 1 Drawing Sheet

SHUTTLE DRIVEN SEPARATOR

FIELD OF THE INVENTION

The present invention relates to a shuttle for transferring parts between presses and particularly to transferring a pair of parts formed in one press to a pair of secondary presses.

DESCRIPTION OF PRIOR DEVELOPMENTS

In the manufacture of stamped metal parts, it is known to form a pair of stampings from a single sheet of stock material in a first or primary die press and to transfer the stampings to a shuttle. The shuttle then carries the stampings to a pair of secondary dies where further stamping operations are carried out.

In order to load the stampings into the secondary presses, a pair of operators was required to manually lift each stamping off the shuttle and move each stamping sidewards or transversely of the shuttle and into the secondary die. This separation of the parts is necessary since the die cavities of the secondary presses are typically separated by a greater distance than the initial spacing of the parts formed in the primary die. Although automated equipment is available for lifting the parts from a shuttle and placing the parts into a pair of dies, such equipment is not readily adapted to laterally separating the parts once they are removed from the shuttle. Rather, such equipment is more reliable and more readily adapted to a single plane of motion.

Accordingly, a need exists for an apparatus for transversely or laterally separating a pair of parts removed from a first die press and positioning such parts for automatic placement into a pair of spaced-apart secondary die presses.

SUMMARY OF THE INVENTION

The present invention has been developed to fulfill the needs noted above and therefore has as object the provision of an apparatus for laterally separating a pair of parts carried by a shuttle. Another object is to effect such lateral separation completely mechanically using only the driving force of the shuttle to separate the parts.

To achieve these and other objects, the present invention has been designed and constructed as a completely mechanically actuated apparatus which receives two individual stampings from a die in which the stampings are initially formed from a single piece of sheet metal. The stampings could be automotive parts such as inner wheel wells, fenders and the like. These stampings are then transferred by shuttle to two separate secondary die presses for further forming. Since the die cavities of the secondary dies are separated from one another, the two separate stampings are laterally separated before being fed into the secondary dies. As noted above, in the past, two operators were required to manually lift the two die stampings into the secondary dies.

The subject invention eliminates the need for operators by receiving two stampings directly from the primary die press via robotically operated lifting arms. These arms position the two stampings on two carriers or supports mounted on a pair of parallel slide rails guided along a central guide rod. A compression spring is mounted between each end of the guide rod and the respective support thereby urging the two supports towards one another in a closed or abutting configuration.

A cam follower in the shape of a roller is attached to each of the supports. The initial spacing of the supports is provided by adjustable bumpers which engage one another thereby limiting the inward travel of the supports over the slide rails.

A toothed belt, chain or other drive mechanism of known construction is actuated to slide the shuttle carriage back and forth between the respective die presses. As the rollers engage a wishbone-shaped spreader cam, the supports are spread apart against the biasing force of the compression springs. At the end of travel of the shuttle, the two spaced-apart stampings are then fed into the secondary stamping dies within a single plane of motion by robotically operated lifting arms of conventional construction. As the shuttle returns to the first die press, the compression coil springs force the supports towards one another until the bumpers engage one another and thereby maintain the spacing of the supports at a proper distance for receiving the next pair of stampings from the primary die press.

IN THE DRAWINGS

FIG. 1, the sole drawing FIGURE, is a perspective view of a shuttle driven separator assembly constructed in accordance with the invention and showing the separator assembly at its two extreme positions of travel on the shuttle.

DETAILED DESCRIPTION OF THE PREFERRED EMBODIMENT

Figure 1:
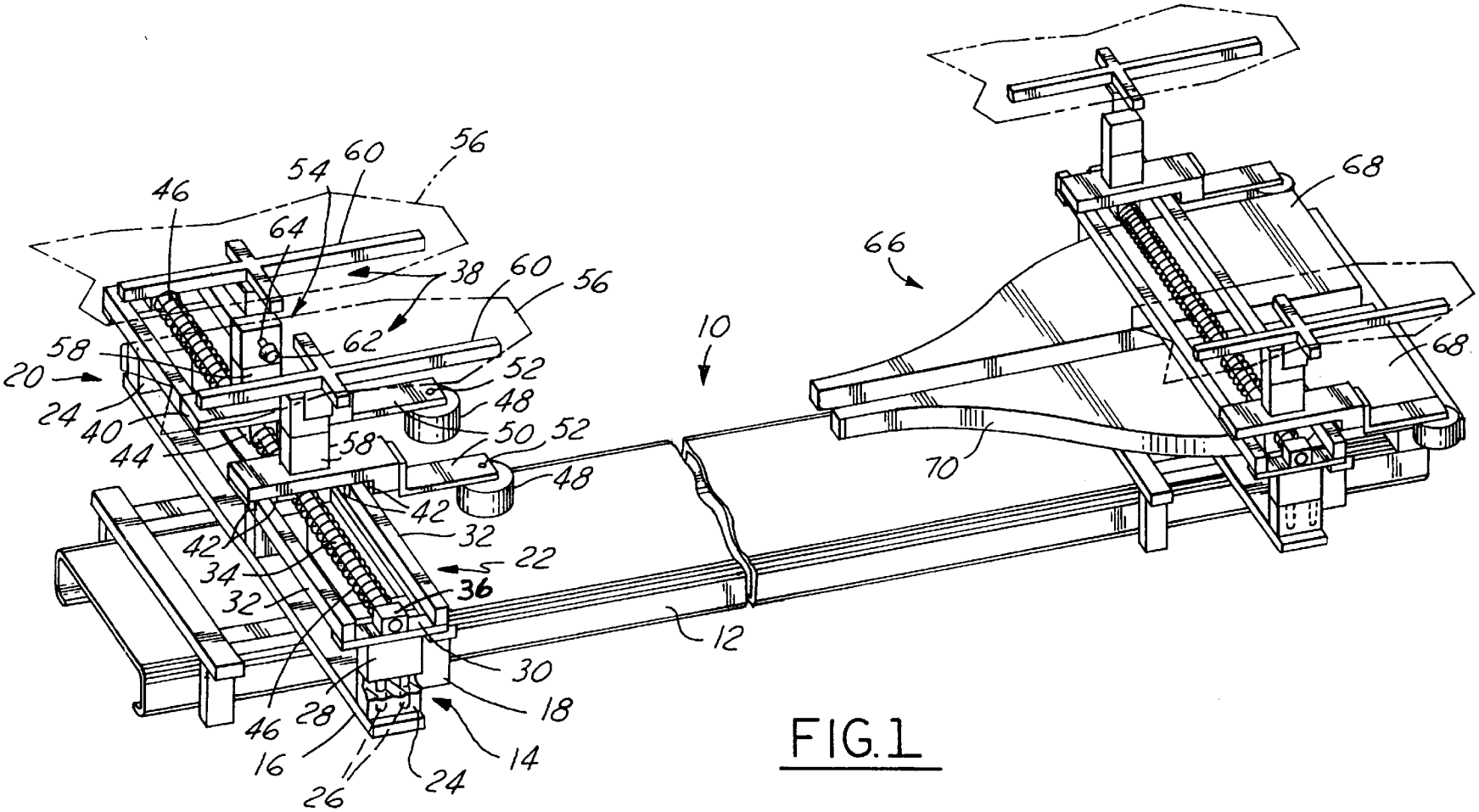

The present invention will now be described in conjunction with FIG. 1 which schematically depicts a shuttle 10 of conventional construction and well known in the metal fabrication industry. Shuttle 10 includes a longitudinally extending fame 12 upon which a shuttle carriage 14 is mounted. Shuttle carriage 14 includes an upper transversely extending support bar 16 connected to a drive bar 18 which extends beneath frame 12.

Drive bar 18 is engaged with a shuttle drive mechanism such as a motor driven chain or toothed belt which extends beneath and along the length of frame 12. The chain or belt is driven in a timed fashion to cause the shuttle carriage to travel back and forth along the frame 12. As described up to this point, the shuttle 10 is of known construction and is commercially available for carrying parts between work stations.

In order to transversely or laterally separate a pair of parts as they are carried by shuttle 10, a separator assembly 20 has been constructed in accordance with the invention. The separator includes a slide assembly 22 mounted to the shuttle carriage 14 via mounting blocks 24 fixed on carriage support bar 16. Mounting blocks 24 may be formed with mounting holes for receiving mounting pins 26 fixed to the bottom of the slide assembly 22.

A spacer bar 30 is connected to the top of each mounting block 28. First and second longitudinally spaced parallel slide rails 32 extend transversely and perpendicularly across the shuttle frame 12. Each slide rail 32 is mounted and fixed to each spacer bar 30. A cylindrical guide rod 34 is also mounted and fixed to each spacer bar 30 via mounting blocks 36. Guide rod 34 extends midway between and parallel to the slide rails 32.

First and second cam follower assemblies 38 are slidably mounted to the slide assembly 22 via slide members 40. Each slide member 40 is provided with a pair of linear bearings 42 for engaging and guiding each cam follower assembly transversely across the shuttle 10 while sliding over the slide rails 32.

A guide block 44 is mounted to each cam follower assembly 38 for guiding and stabilizing the cam follower assemblies as they reciprocate over the slide rails 32. A bore is formed through each guide block 44 for slidably receiving the guide rod 34.

The cam follower assemblies are urged or biased toward one another by a pair of compressed cylindrical coil compression springs 46. Each spring 46 is concentrically mounted over one end of guide rod 34, with one end abutting a mounting block 36 and the other end abutting a guide block 44.

Each cam follower assembly 38 is provided with a cam follower such as cylindrical wheels or rollers 48. As shown, each roller 48 is rotatably mounted to a slide member 40 via mounting arm 50 fixed to the slide member and projecting longitudinally from each cam follower assembly 38. A vertical stub shaft 52 rotatably mounts each roller to the end of each mounting arm.

A support assembly 54 is provided on each cam follower assembly 38 for receiving, supporting and carrying parts such as stamped body panels 56 on and along shuttle 10. A base 58 is mounted to the top of each slide member 40 for supporting a support structure such as the cross-shaped panel holding bucks 60 connected to the top of base 58.

Although bucks 60 are shown for purposes of illustration, any suitable support surface may be used. For example, for curved parts such as fenders or wheel wells, complementary shaped contoured supports can be used to accurately position and center the parts on the cam follower assemblies 38.

Bumpers 62 are provided on the inner face of each base 58 for engaging each other and setting a minimum spacing between the juxtaposed cam follower assemblies 38. Each bumper 62 may be mounted on a threaded shaft 64 which is threaded into a threaded bore formed in the side of each base 58. In this manner, the minimum spacing between the cam follower assemblies can be adjusted.

As seen in FIG. 1, the separator assembly 20 shown at the left is positioned to receive the panels 56 from a primary die press within which the two panels are stamped from a single sheet. A robotic lifting arm is typically used to remove the panels from the die and position them on the bucks 60. At this point, the shuttle 10 is activated to drive the separator assembly 20 to the opposite end of the shuttle 10 and thereby position the panels 20 for lifting by a second robotic lifting arm into a pair of secondary die presses.

In order to separate and laterally spread apart the panel bucks 60 from their initial position on the left side of FIG. 1 to the position shown on the right side of FIG. 1, a cam assembly 66 is mounted centrally over the right end of the shuttle frame 12. The cam assembly may be mounted directly to the frame 12 or to a rigid support or floor upon which the frame 12 is mounted.

Cam assembly 66 includes a pair of wedge-shaped cam plates 68 which together define a somewhat wishbone-shaped cam for engaging the cam follower rollers 48 and transversely wedging them apart. Each cam plate 68 includes a contoured side running surface 70 against which the cam follower rollers smoothly roll.

Once the separator assembly 20 reaches the end of its rightward travel, the shuttle dwells thereby allowing removal of the panels 60. At this time, the shuttle is reactivated thereby driving the separator assembly back to its original position on the left of FIG. 1.

As the shuttle 10 drives leftward to return the carriage to its initial position, the springs 46 force the cam follower assemblies 28 toward one another as they move over the cam assembly 66. When the carriage and separator assembly 20 reach their leftmost position, the shuttle 10 then again dwells to allow the loading of another pair of panels on bucks 60. At this point, the cycle repeats itself.

It can be appreciated that the entire shuttle process can be completely automated and that existing shuttles may be used without modification from prior manual operational form. Moreover, no extra source of power is required to actuate the separator assembly insofar as the shuttle 10 provides the power to drive the cam follower assemblies 28 over the cam assembly 66.

It should be understood that while this invention has been discussed in connection with one particular example, those skilled in the art will appreciate that other modifications can be made without departing from the spirit of this invention after studying the specification, drawings, and the following claims.

We claim:

1. A separator for separating first and second parts carried by a shuttle, comprising:

a slide assembly mountable on said shuttle;

a first cam follower assembly slidably mounted on said slide assembly;

a second cam follower assembly slidably mounted on said slide assembly;

a first support carried by said slide assembly for supporting said first part;

a second support carried by said slide assembly for supporting said second part;

a cam aligned with said shuttle and said first and second cam follower assemblies for engaging said first and second cam followers and separating said first and second supports transversely of said shuttle;

a first member biasing said first cam follower assembly toward said second cam follower assembly; and a second member biasing said second cam follower assembly toward said first cam follower.

2. The separator of claim 1, wherein said slide assembly comprises a pair of slide rails and wherein said first and second cam follower assemblies are each slidably mounted on said slide rails.

3. The separator of claim 1, wherein said first and second cam follower assemblies each comprises an adjustable stop member for maintaining separation between said cams.

4. The separator of claim 1, wherein said first and second cam follower assemblies each comprises a pair of linear bearings mounting said cam follower assemblies to said slide assembly.

5. A separator for separating first and second parts carried by a shuttle, comprising:

a slide assembly mountable on said shuttle;

a first cam follower assembly slidably mounted on said slide assembly and comprising a first roller;

a second cam follower assembly slidably mounted on said slide assembly and comprising a second roller;

a first support carried by said slide assembly for supporting said first part;

a second support carried by said slide assembly for supporting said second part;

a cam aligned with said shuttle and said first and second cam follower assemblies for engaging said first and second cam follower assemblies and separating said first and second supports transversely of said shuttle.

6. A separator for separating first and second parts carried by a shuttle, comprising:

a slide assembly comprising a guide rod and mountable on said shuttle;

a first cam follower assembly slidably mounted on said slide assembly;

a second cam follower assembly slidably mounted on said slide assembly;

a first support carried by said slide assembly for supporting said first part;

a second support carried by said slide assembly for supporting said second part;

a cam aligned with said shuttle and said first and second cam follower assemblies for engaging said first and second cam follower assemblies and separating said first and second supports transversely of said shuttle; and spring biasing means mounted over said guide rod and biasing said first and second cam follower assemblies toward each other.

7. A separator for separating first and second parts carried by a shuttle, comprising:

a slide assembly mountable on said shuttle;

a first cam follower assembly slidably mounted on said slide assembly;

a second cam follower assembly slidably mounted on said slide assembly;

a first support carried by said slide assembly for supporting said first part;

a second support carried by said slide assembly for supporting said second part; and a cam comprising a fixed wedge aligned with said shuttle and said first and second cam follower assemblies for engaging said first and second cam follower assemblies and separating said first and second supports transversely of said shuttle.

8. The separator of claim 7, wherein said fixed wedge comprises a substantially wishbone-shaped profile.

9. A separator for separating first and second parts carried by a shuttle, comprising:

a slide assembly mountable on said shuttle;

a first cam follower assembly slidably mounted on said slide assembly;

a second cam follower assembly slidably mounted on said slide assembly;

a first support carried by said slide assembly for supporting said first part;

a second support carried by said slide assembly for supporting said second part; and a cam comprising a pair of wedge members aligned with said shuttle and said first and second cam follower assemblies for engaging said first and second cam follower assemblies and separating said first and second supports transversely of said shuttle.

* * * * *